United States Patent [19]

Sparks

[11] Patent Number: 4,483,532

[45] Date of Patent: Nov. 20, 1984

[54] EXERCISE MACHINE

[75] Inventor: Roger C. Sparks, Ellensburg, Wash.

[73] Assignee: Second Century Farms, Inc., Ellensburg, Wash.

[21] Appl. No.: 159,487

[22] Filed: Jun. 16, 1980

[51] Int. Cl.[3] ..... A63B 23/04

[52] U.S. Cl. ..... 272/96; 128/25 B; 272/132

[58] Field of Search ..... 272/132, 131, 134, 138, 272/143, 144, 142, DIG. 3, DIG. 5, DIG. 6, 96, 72, 73, 69, 125, 146, 135; 73/379, 380; 128/25 R, 25 B

[56] References Cited

U.S. PATENT DOCUMENTS

| | | | |
|---|---|---|---|
| 137,394 | 4/1873 | Tice | 272/132 |
| 2,760,774 | 8/1956 | Perez | 272/142 X |
| 3,430,955 | 3/1969 | Mack | 272/135 |
| 3,591,172 | 7/1971 | Hude | 272/142 X |
| 3,602,502 | 8/1971 | Hampl | 272/DIG. 6 |
| 3,612,519 | 10/1971 | Larson | 272/146 |
| 3,744,480 | 7/1973 | Gause et al. | 272/DIG. 6 |
| 3,782,721 | 1/1974 | Passera | 272/96 |
| 3,861,215 | 1/1975 | Bradley | 272/132 |
| 4,186,920 | 2/1980 | Fiore et al. | 272/96 |
| 4,199,137 | 4/1980 | Gignère | 272/132 |

FOREIGN PATENT DOCUMENTS

| | | | |
|---|---|---|---|
| 469473 | 5/1973 | U.S.S.R. | 272/132 |

*Primary Examiner*—Richard J. Apley
*Assistant Examiner*—Stephen R. Crow
*Attorney, Agent, or Firm*—Cole, Jensen & Puntigam

[57] ABSTRACT

An exericse machine primarily used in exercising and strengthening muscles and ligaments not normally affected by the standard dynamic and/or isometric approaches. The machine causes the user to work against a centrifugally operated brake which increases the resistance to movement as the rate of movement increases. A horizontally disposed lever including a stirrup is rotated about a vertical shaft by the foot and leg of a user, and the shaft is functionally connected to a speed increasing mechanism and its rate of rotation is regulated by a centrifugal brake. The amount of effort being expended to overcome the brake resistance is displayed by a simple linkage from the brake mechanism to an easily visible indicator.

3 Claims, 5 Drawing Figures

EXERCISE MACHINE

BACKGROUND OF THE INVENTION

Numerous exercise methods and machines have been developed over the years for strengthening and rehabilitating damaged muscle tissue as well as developing desired muscle tissue. In general, these machines and methods operate on a resistance to movement theory but are limited to those motions which are normally attributed to the particular part of the anatomy, as for example, the normal flexure of the leg or arm. It has been demonstrated, however, that rehabilitation from some injuries and in particular those of a joint require an exercise fostering development and/or strengthening of muscles which are normally little used or used only in particular situations involving unusual movement.

In particular, with respect to the knee, following an injury the party may continue to suffer from a weakened joint condition until those muscles and interconnecting fibers which control lateral and medical movement are strengthened. Obviously, the normal flexing of the leg and foot in a known exercise program will increase the strength of the thigh, calf and other muscles which control the normal flexing movement, i.e., walking, running, and the like. However, those muscles which assist the joint structure in preventing lateral or sideways motion of the joint are not substantially affected by the normal exercise methods or machinery. A careful study of the anatomy of the knee joint reveals a very complex structure; the movement in any direction requires the sliding and relative motion of many separate but interrelated parts.

Prior art devices known to the present inventor include the exercise apparatus disclosed in U.S. Pat. No. 2,668,709 granted Feb. 9, 1954, to Bokyo. This disclosure includes a bicycle pedal-like device for exercising and strengthening the legs in their normal flexing motion and includes as an integral part thereof a manually adjustable brake for controlling the amount of energy necessary to turn the cranks.

Further, U.S. Pat. No. 3,451,674 granted June 24, 1969, to Lundgren, et al, discloses another bicycle-type exercise machine utilizing a standard crank mechanism for exercising the flexure muscles wherein a brake operating in response to centrifugal force increases the resistance to movement as the speed of the device increases.

With the above-noted prior art and background in mind, it is an object of the present invention to provide an exercise machine particularly utilized to increase the strength of those muscles which contribute to the lateral and medial stability of a joint.

It is another object of the present invention to provide an exercise machine which is simple and yet provides a means for increasing the resistance to movement as the strength and ability of the user increases.

Still another object of the present invention is to provide a machine including a display device wherein the user can readily determine the relative amount of resistance and therefore the amount of exercise being performed, thereby being able to regulate and control his progress.

Yet another object of the present invention is to provide an exercise machine primarily for use from a standing position. The particular structure of the machine is such that the user is actively involved and yet the exercise to the critical part of the body i.e., the knee, is to a large measure isometric.

A still further object of the present invention is to provide an exercise machine which because of its configuration and the particular posture of the operator exercises a large percentage of the body ancillary to the main purpose.

DETAILED DESCRIPTION OF THE DRAWINGS

Figure 1:
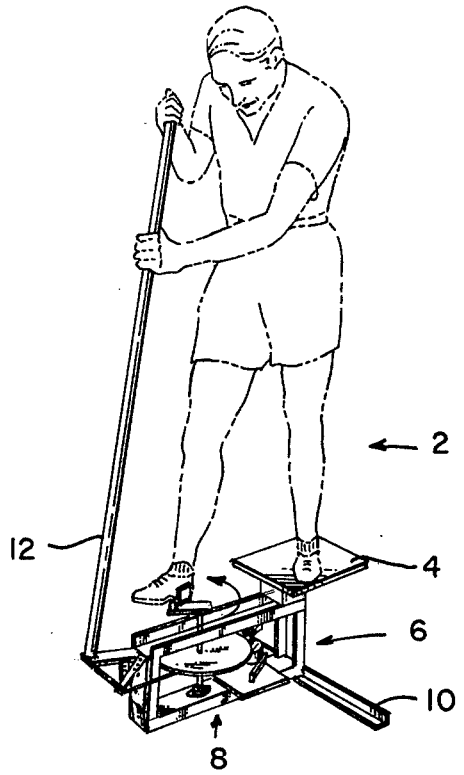
FIG. 1 is a perspective view of the exercise machine with an operator in a position of usage.

As seen in FIG. 1, the exercise device in its preferred embodiment, is designed to be used by a person in the standing position. As seen in this view, the operator 2 stands upon a platform 4 supported by framework, generally designated as 6, which supports the platform 4 and provides a stable base for both the individual 2 and the exercise mechanism generally designated as 8. It is to be noted that the framework 6 has outwardly extending outrigger elements 10 to increase the stability. An upwardly extending handle or support member 12 is included since the operator, when using the machine, will be standing with one foot on platform 4 and the other foot placed within a stirrup-type mechanism as explained hereinafter.

The exercise is performed by the operator moving his foot, placed within the stirrup, and lower leg in a small circular motion against a variable resistance. The necessity of maintaining a balance while using the exercise machine requires that the operator alternately tense and relax muscles that are not directly being exercised by the rotary motion. The leg which is controlling the rotation is kept in a relatively stable but straightened position. The knee joint is thus substantially rigid and the muscles, ligaments, etc., which control the medial and lateral movements are subjected to an exercise most closely related to isometrics.

Figure 2:
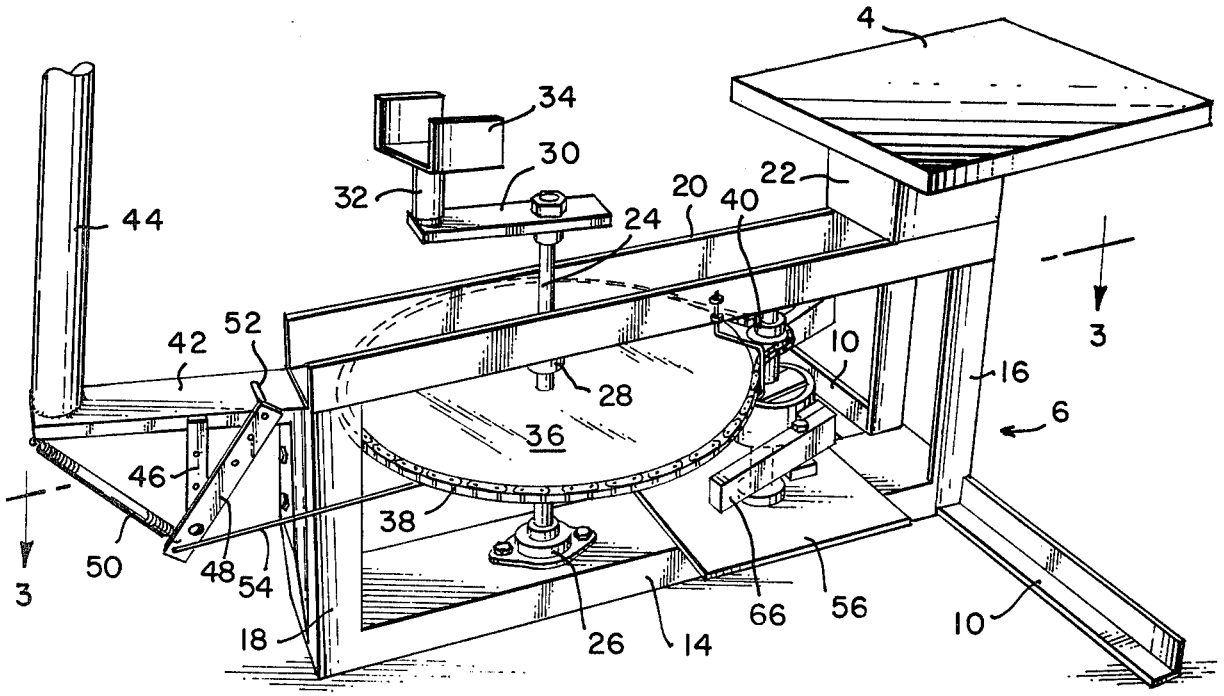
FIG. 2 is an enlarged perspective view of the exercise machine.

Referring now to FIG. 2, it can be seen that the platform 4 is supported by the framework 6 which includes as an integral part thereof in addition to the outriggers 10 a horizontal main member 14 for contact with the supporting surface and a pair of uprights 16 and 18 bridged by a second horizontal member 20. Although this is the preferred embodiment, it is within the contemplation of the present invention to include a platform for sitting, a device for placement adjacent a chair or the like and further, mounting the device on a wall for use in arm or shoulder rehabilitation. The four frame elements 14, 16, 18, and 20 define a space into which the braking or variable resistance mechanism is placed. The platform 4 sits at one end of the vertical generally rectangular framework 6 adjacent the outriggers 10 for maximum stability. It is to be noted the platform 4 is spaced above the frame member 20 by means of a spacer 22 so that it is located at approximately the same height as the foot receiving stirrup hereinafter described.

Mounted so that it extends vertically through the upper portion 20 of frame member 6 is a vertical shaft 24 mounted for rotation between bearing members 26, mounted to frame member 14, and 28, mounted to frame member 20. The shaft 24 extends vertically upwardly to terminate in crank arm 30 having pivotally mounted to the outer end thereof a stub shaft 32 and a pivotally mounted stirrup 34 to receive and cradle the user's foot.

Mounted between the frame members 14 and 20 is a horizontal placed sprocket wheel 36 having engaged therewith chain member 38 which engages and functionally links sprocket 38 to smaller sprocket 40 as explained hereinafter.

Secured to the opposite end of frame member 6 from platform 4 is an L-shaped bracket member 42 having rigidly secured thereto a vertical stabilizing member 44 such that it can be grabbed by an operator during utilization of the exercise machine. Also mounted on the L-shaped bracket 42 and explained in greater detail hereinafter, is the means for indicating the relative resistance generated during operation. In general, the indicator consists of a vertically mounted support member 46 to which a pivotally mounted lever 48 is mounted. A return spring 50 is mounted between the short end of lever 48 and a fixed point on bracket 42. An indicator element 52 which moves along the upper face of bracket 42 having a visible comparative scale thereon, is mounted to the long end of lever 48. A connecting rod 54 transmits the force generated, as explained hereinafter, and thus controls the position of the indicator member 52.

Figure 3:
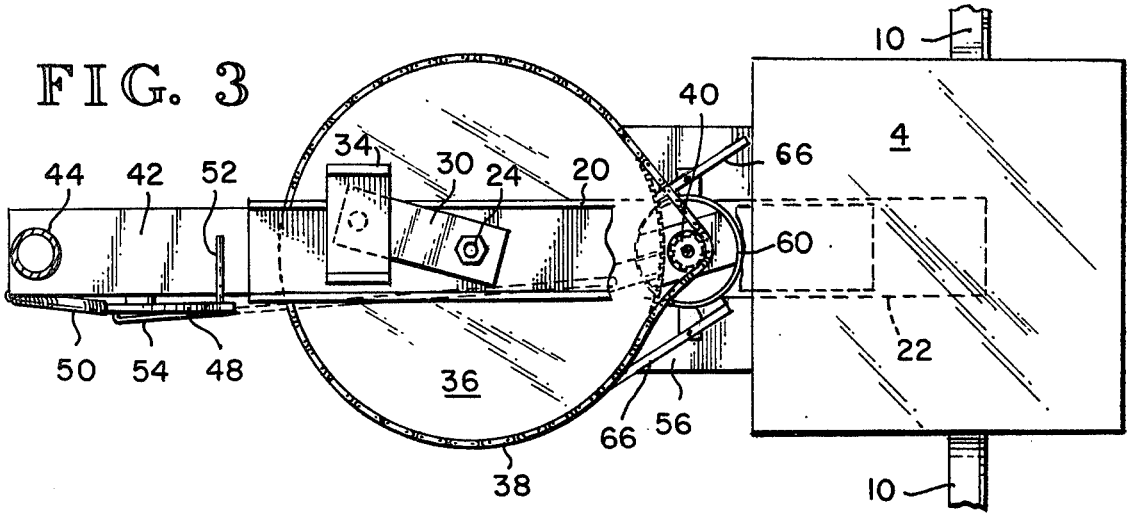
FIG. 3 is a plan view of the exercise machine of FIG. 2.

Referring now to FIG. 3, the various elements of the exercise machine can be seen in their relative position from the top view. As seen in this view, the crank 30 causes the sprocket 36 to rotate moving chains 38 which in turn causes the sprocket 40 to rotate. Sprocket 40 is mounted to a vertical shaft 58 (see FIG. 4) extending downwardly to a horizontal plate 56 mounted upon the lower element 14 of the frame 6.

Figure 4:
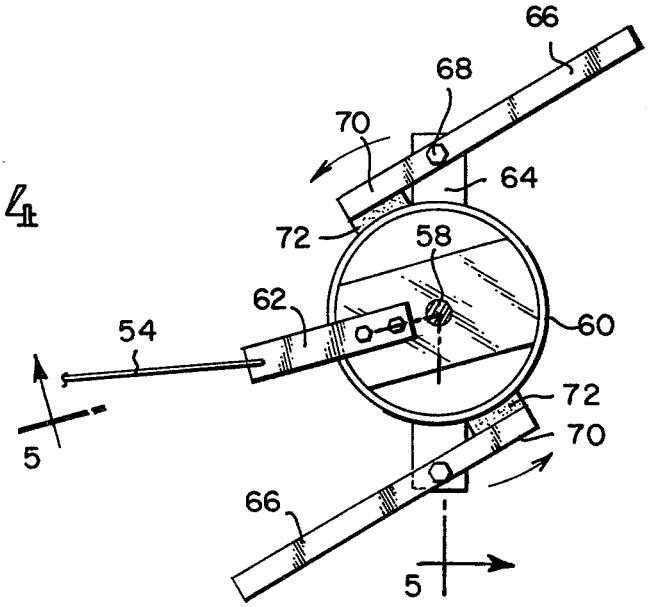
FIG. 4 is an enlarged view of the centrifugal braking mechanism utilized on the present invention.
Figure 5:
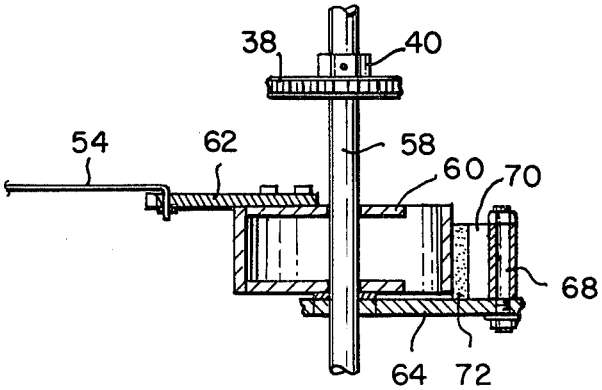
FIG. 5 is a vertical sectional view taken along lines 5—5 of FIG. 4.

Referring now to FIGS. 4 and 5, it is to be noted that the vertical shaft to which the sprocket 40 is mounted is designated as 58 and although not shown in detail, is appropriately mounted within bearings. Mounted for free rotation about shaft 58 is a drum or wheel 60 restrained from unlimited movement by means of a lever 62 mounted to the drum or cylinder 60 which is attached to connecting rod 54. The free movement is thus limited by the reaction of spring 50.

As the machine is operated, the shaft 58 is caused to spin. Mounted for movement with shaft 58 is a horizontal elongated element 64 which extends outwardly beyond wheel or cylinder 60 on diametrically opposed sides. Mounted for rotational movement relative to the elongaged element 64 are a pair of braking elements 66 which are mounted for rotation about vertical pin 68 in an unbalanced fashion such that the rotation of the shaft 58, which causes the element 64 to spin, causes the elongaged end or heavier end of the element 66 to move outwardly causing the shorter end 70 upon which a brake pad 72 is mounted to contact the exterior of the cylinder or drum 60. The friction between the brake pad 72 and the exterior of the drum causes the drum to rotate against the spring resistance and thereby moves the indicator 52.

Thus as can be seen, the present invention provides a unique means whereby the fibrous parts which control the movement of the knee joint may be quickly and easily strengthened and exercised and the operator of the device can selectively control the amount of resistance and speed at which he operates his device.

What is claimed is:

1. An exercise machine for strengthening the lateral and medial muscles adjacent the knee comprising:

framework means supporting a platform in a stable condition, crank means rotatable through full revolutions when in use including a crank arm and a stirrup mounted to the framework means adjacent the platform such that a person standing on the platform may comfortably operate the crank means with one foot, rotatable vertical shaft means extending vertically downward from the crank means, through the upper portion of the framework means and terminating adjacent the lower portion of the framework means, whereby said crank means is operated in a repetitive rotatable motion and brake means automatically variably resisting rapid rotation of the shaft means.

2. An exercise machine as in claim 1, wherein the brake means comprise a drum and at least one brake pad pivotally mounted upon a lever which presses the pad against the drum with greater force when the vertical shaft means rotates more rapidly.

3. An exercise machine as in claim 1 and further including means to indicate the relative work being done by the user of the machine.

* * * * *